United States Patent [19]

Stahl

[11] Patent Number: 4,601,132

[45] Date of Patent: Jul. 22, 1986

[54] MACHINE EQUIPPED WITH A GRINDING BAND

[76] Inventor: Helmut Stahl, Bergle 5, 7205 Böttingen, Fed. Rep. of Germany

[21] Appl. No.: 689,065

[22] Filed: Jan. 7, 1985

[51] Int. Cl.[4] ..... B24B 21/00

[52] U.S. Cl. ..... 51/135 BT; 198/842

[58] Field of Search ..... 51/135 B, 135 BT; 198/834, 842; 474/152, 153, 901, 175

[56] References Cited

U.S. PATENT DOCUMENTS

| | | | |
|---|---|---|---|
| 272,433 | 2/1883 | Harrison | 474/175 |
| 2,479,506 | 8/1949 | Payton | 51/141 |
| 2,497,949 | 2/1950 | Linsmeier | 51/141 |
| 2,556,041 | 6/1951 | Pick | 51/135 R |
| 2,725,691 | 12/1955 | Sommer | 51/135 R |
| 2,732,669 | 1/1956 | Conley | 51/141 |
| 2,763,103 | 9/1956 | Bader | 51/135 R |
| 3,400,804 | 9/1968 | Phillips | 198/842 |
| 3,488,889 | 1/1970 | McCay | 51/135 R |
| 3,507,160 | 4/1970 | McPherson | 198/842 |
| 4,185,609 | 1/1980 | Petera | 51/135 BT |

*Primary Examiner*—Harold D. Whitehead

*Attorney, Agent, or Firm*—Erwin S. Teltscher

[57] ABSTRACT

A grinding machine equipped with a grinding band consists substantially of a motor-driven contact disk supported in a machine frame, which has a horizontal axle, a rotatable rerouting unit, which has a shaft parallel with the axle, and wherein the grinding band is slack and not bend-resisting, and is guided over the contact disk and the rerouting unit. In a take-up region of the contact disk there are disposed lateral guidance jaws of an abrasion-resistive ceramic material. A lower strand of the grinding band is suspended downwardly, while being acted upon by band-tensioning means. The rerouting unit includes a plurality of U-shaped wire members connected to a hub of the rerouting unit, spaced radially therefrom, and spaced from one another, whose outwardly concave cross-rods form a line-like support for the grinding band. As the U-shaped wire members are very lightweight, the rerouting unit has a very low moment of inertia, so that it can follow any changes in the rotating velocity of the grinding band almost instantaneously, and in a slip-free manner, even at the lowest band tension.

22 Claims, 9 Drawing Figures

MACHINE EQUIPPED WITH A GRINDING BAND

CROSS REFERENCE TO RELATED APPLICATIONS AND PUBLICATIONS

1. German Pat. No. DE 2400267.
2. Concurrently filed application "Polishing Disk".

FIELD OF THE INVENTION

The present invention relates to a machine equipped with a grinding band, which includes a frame, a contact disk supported in the frame and optionally driven by a 10 motor, at least one rotatable rerouting unit having an axle parallel to that of the contact disk, and a grinding band guided over the contact disk and the rerouting unit.

BACKGROUND OF THE INVENTION

In a band-grinding machine of this type, which includes a motor-operable contact disk, it is known from German Pat. No. DE 2400267 to make use of a rerouting roller, which has a relatively low mass compared to its diameter, and to provide a band-tensioning device, which at the operating velocity of the grinding band, subjects the grinding band to a low force of about 0.5 to 5N. The rerouting roller is formed thereat as a spoke wheel, the periphery of which is formed as a smooth circular running surface. So as to avoid any jumping off of the grinding band at high velocities of travel, the running surface of the rerouting roller, as well as that of the contact disk is outwardly convexly curved in a direction at right angles to the longitudinal direction of the band. But in order to prevent the grinding band from jumping off also during starting, the grinding band is initially adjusted to an increased tension with the aid of a band tensioning device and/or by means of an adjustment of the axial spacing between the rerouting roller and the contact disk. After the required band velocity has been reached, which is suitable for grinding, the band tension is reduced thereafter to a somewhat lower value suitable for normal operation. When the band is gradually or abruptly brought to a halt, it is hard, however, to avoid any further rotation of the rerouting roller, in spite of its low weight, and to prevent the grinding band from coming off therefrom.

SUMMARY OF THE INVENTION

It is an object of the invention to create a band grinding machine of the initially described type, which ensures a largely slip-free entrainment of the rerouting unit, even at very low band tensions, and both at low band velocities, as well as at high band velocities, and when the band velocity is abruptly changed.

This object of the invention is attained by the rerouting unit including along its peripheral direction cross-rod-members, rib-members or edge-members spaced from one another, and forming a band support, which in turn substantially provides a line-shaped support for the grinding band covering these members; thus the grinding band forms a polygon, as seen in side view.

The invention is based on the recognition that a rerouting unit is better entrained by a grinding band at low tension, and which does not resist bending, if its band support or running surface is not round, but is formed with crossrods, which in turn may be surrounded by the band, so that the band has a polygonal periphery. Due to the formation of a slight bend in the grinding band within the region of the crossrods, an increased adhesive resistance between the grinding band and the contact disk results. If, in a preferred embodiment of the invention, the band support of the rerouting unit is formed by substantially U-shaped wire units, where the wire units are peripherally spaced from one another, and extend radially from a hub of the rerouting unit, and where each U-shaped wire unit includes a crossbar, then the construction of the rerouting unit is particularly lightweight, and has the lowest possible moment of inertia. Such a rerouting unit may follow almost instantaneously and without any slip any changes in the velocity of rotation of the grinding band, even at the lowest band tension.

If the support bars, support ribs or support edges of the rerouting unit are considerably wider than the width of the grinding band, then a grinding band guided in a take-up region of the contact disk automatically aligns itself on the rerouting unit. But it has been shown to be particularly advantageous to provide a separate lateral guidance on the rerouting unit, which may be formed by the support bars, support ribs or support edges being concavely curved facing the grinding band and/or having at the ends radially extending rims forming a track for the band. Such guiding means are effective both at low peripheral band velocities, as well as at high band peripheral velocities, down to the lowest possible band tensions, and even permit operation with a freely suspended grinding band.

The novel features which are considered as characteristic of the invention are set forth in particular in the appended claims. The invention itself, however, both as to its construction and method of operation, together with additional objects and advantages thereof, will best be understood from the following description of the specific embodiments read in connection with the accompanying drawings.

DESCRIPTION OF THE PREFERRED EMBODIMENTS

Figure 1:
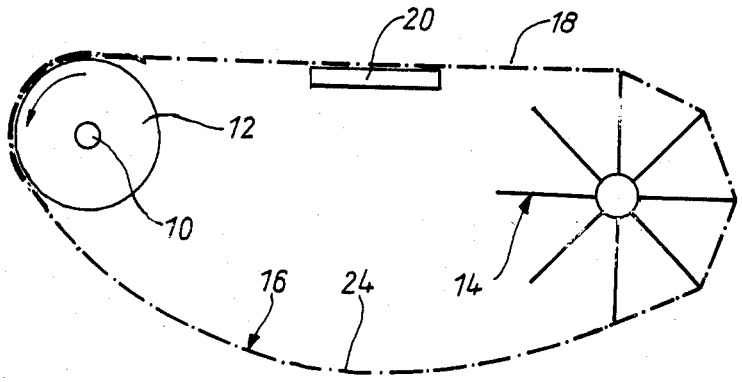
FIG. 1 is a side view of a band-grinding machine having a star-shaped rerouting unit, and a freely suspended grinding band.
Figure 2:
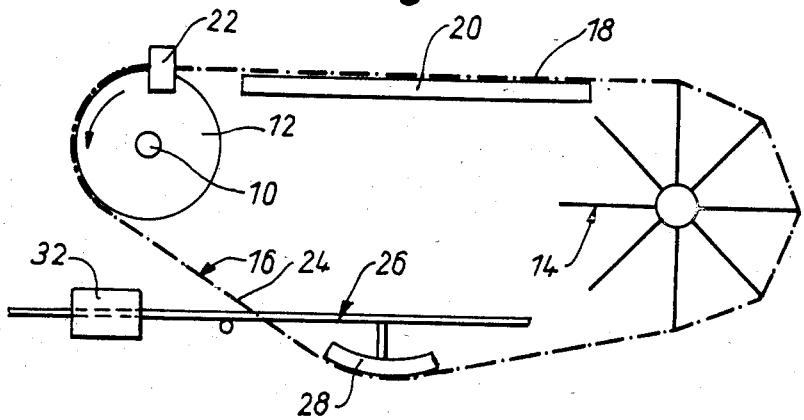
FIG. 2 is a side view of a band-grinding machine equipped with a band-tensioning arrangement.
Figure 3:
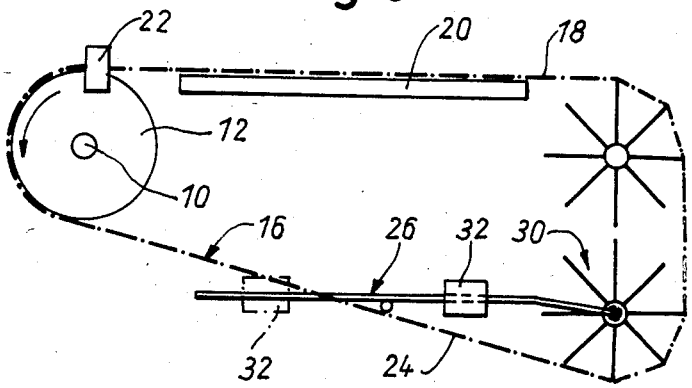
FIG. 3 is a side view of a further embodiment example of a band-grinding machine having a band-tensioning arrangement.
Figure 4:
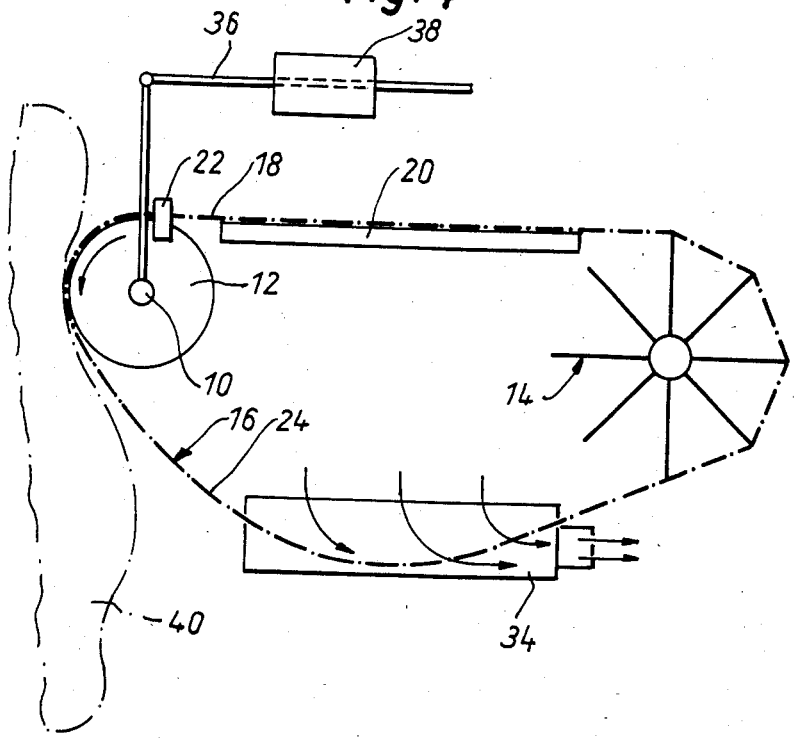
FIG. 4 is a side view of an automatic band-grinding machine equipped with a suction box.

The band-grinding machine shown schematically in FIGS. 1–4 consists substantially of a motor-driven contact disk 12 supported in a non-illustrated machine frame having a horizontal axle 10, a rerouting unit 14 axially parallel to the contact disk 12, and a grinding band 16 guided over the contact disk 12, and the rerouting unit 14; the grinding band is slack or non-resilient, when bent. An upper strand 18 of the grinding band 16 is guided over a sliding surface 20, which in turn is formed on the machine frame along an upper common tangential plane of the contact disk 12 and of the rerouting unit 14. In the take-up region of the contact disk 12, there may be disposed lateral guidance jaws made of a ceramic material, which resists grinding (FIGS. 2–4). The lower strand 24 of the grinding band is suspended downwardly either freely (FIG. 1), or is acted upon by a band-tensioning device 26 (FIGS. 2 and 3), or is subjected to suction (FIG. 4).

The band-tensioning device 26, according to FIGS. 2 and 3, is implemented as a two-armed lever in the fashion of a scale, on whose loading arm there is disposed a pressure element 28 or 30 abutting the band, and which carries a displaceable weight 32 along the force-and/or loading-arm. In the embodiment example according to FIG. 2, the pressure element is implemented as a pressure shoe 28, while in the embodiment example according to FIG. 3 it is implemented as a rotatable rerouting unit 30, which has a low moment of inertia.

In the version shown in FIG. 4, the empty strand 24 of the downwardly hanging grinding band is guided through a box 34, which, in turn, is subjected to suction. Here it is shown schematically how the contact disk 12 articulated on a belt crank or angle lever 36, may be pressed against a work 40 passing therealong, or be optionally guided therealong, while being subjected to a force adjustable to be constant under the influence of a slideable weight 38.

The rerouting units 14 are provided along their periphery with cross-rod members 42, cross-rib members 44, or cross-edge members 46 spaced from another, which support the grinding band 16 guided thereover substantially in a line-like manner. So as to ensure use of a grinding band automatically laying its own track both at a low number of revolutions during the initial starting phase, as well as during high number of revolutions when in steady-state operation, even at low band tensions down to a band tension of zero, the cross-rod members 42, the cross-rib members 44, or the cross-edge members 46 are implemented so as to be concave facing the grinding band 16, and/or are provided with lateral track-guiding rims 48. The rerouting roller 30 of the band-tensioning device 26 can also be implemented in this manner.

Figure 5:
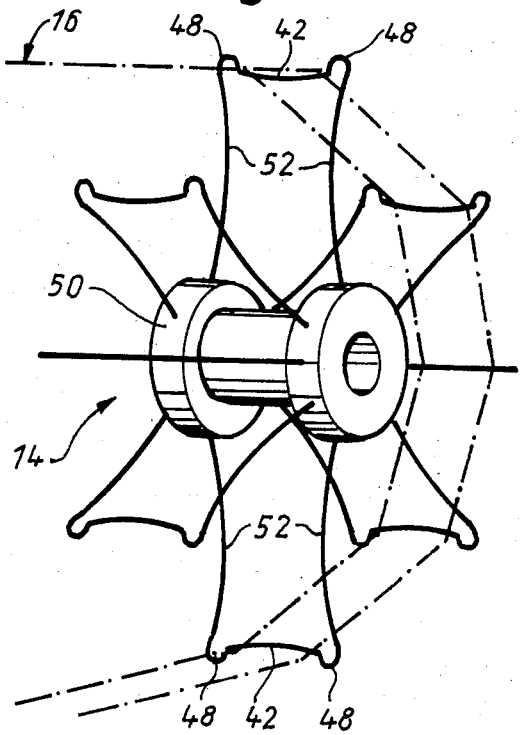
FIG. 5 is a perspective view of a first version of a rerouting unit.
Figure 6:
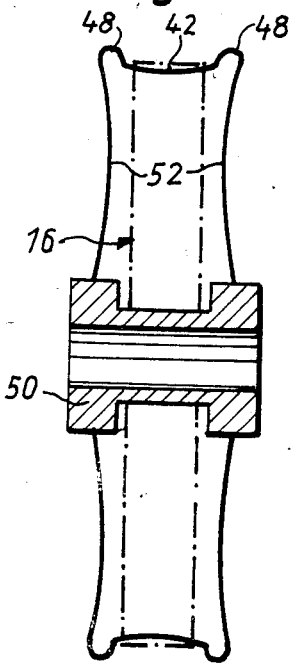
FIG. 6 is an elevation view in part cross-section of the U-shaped wire member of the rerouting unit of FIG. 5.

In the implementation example of a rerouting unit 14 shown in FIGS. 5 and 6, there are fastened to its hub 50, implemented as a bearing, a plurality of U-shaped wire members 52, which extend radially outwardly, and are spaced from one another; their outwardly concavely curved cross-rod members 42 form a substantially line-shaped support for the grinding band 16. The radially outwardly curved rims 48 of the cross-rod members 42 additionally define a track for lateral guidance of the grinding band 16. As the U-shaped wire members 52 are very lightweight, the rerouting unit 14 has a very low moment of inertia in comparison to conventional rerouting rollers; it may therefore follow any changes in the peripheral velocity of the grinding band approximately instantaneously and without any slip, even at very low band tensions. In this manner it is possible to start up the grinding band 16 in a few seconds without any special arrangements and at a lowest band tension, even when the band is freely suspended from rest. Hence an operating velocity of the contact disk and of the rerouting unit of about 3,000 revolutions per second can be reached, and further the grinding band 16 can be stopped abruptly, even when it is travelling at its operating velocity, without the grinding band jumping off from the rerouting unit. The slight bend of the grinding band 16 within the region of the supporting cross-rod member 42 contributes significantly to that feature, which additionally leads to an increased adhesive friction between the grinding band and the contact roller. So as to increase adhesive friction even further, it is furthermore possible to provide within the region of the cross-rod members non-illustrated adhesive friction means, for example a rubber coating. In particular it is possible to surround the band trajectory of the rerouting units formed by the U-shaped wire members 52 with a non-illustrated expandable and tensionable rubber ring, so that there results an effective polygonal periphery of the band support, which hugs the passing grinding band at a high number of revolutions due to the action of the centrifugal force.

Furthermore, the elastic bendability of the U-shaped wire members 52, which consist of resilient wire, contributes to the fact that any inertial forces which may occur when the machine is rapidly started or stopped, are transferred in a slip-free manner between the grinding band and the rerouting unit.

It is no longer required to readjust the band tension during starting and stopping. Furthermore the rerouting unit 14 can be supported on a rigid horizontal shaft of the machine frame. Due to the automatic guidance of the grinding band 16 on the rerouting unit 12, neither a displacement of the rerouting unit for the purpose of changing the axial spacing, nor a tilting thereof for the purpose of automatic matching to the trajectory of the band is required, as indeed has been the case in machines of the prior art.

At bends of the band in the region of the line-shaped band support any gaps between the grinding particles are expanded, so that during operation and at a high number of revolutions the band is automatically cleared or emptied of any dust particles embedded therein due to the centrifugal force acting thereon. This applies to the entire grinding band surface, as during operation each location of the grinding band reaches the line-shaped supports of the rerouting unit 14 sufficiently frequently. The rerouting unit can therefore also be used as an ejector.

Within the region of the contact disk 12 the band trajectory is conventionally convexly curved, as viewed at right angles to the longitudinal band direction, so as to prevent any jumping off of the grinding band 16 from the rerouting disk during operation of the machine. Due to the ensuing alternation between a convex curvature within the region of the contact disk 12, on one hand, and a concave curvature within the region of the rerouting unit 14, on the other hand, equalization of expansion takes place on the grinding band 16, which in turn results in a considerably longer life of the grinding band 16.

Figure 7:
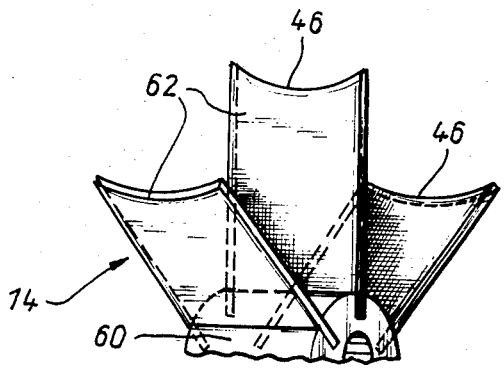
FIG. 7 is a perspective view of another version of a rerouting unit.

In the version of the rerouting unit shown in FIG. 7, the trajectory of the band is defined by plate-like punched or shaped members 62 projecting radially from a hub 60; the shaped members 62 are made of synthetic material or metal, whose radially outwardly projecting concave cross-edge members 46 extend at right angles to the longitudinal direction of the band, and so provide again a substantially line-shaped support for a grinding band 16 passing thereover.

Figure 8:
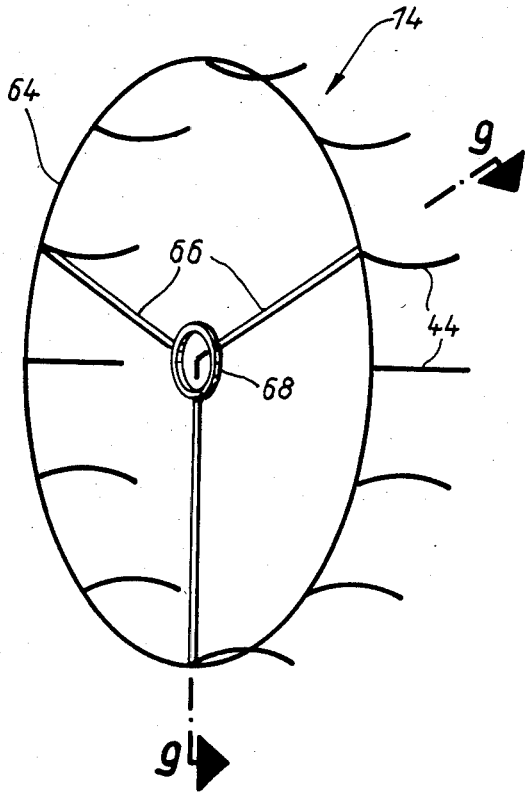
FIG. 8 is a perspective view of still another version of a rerouting unit.
Figure 9:
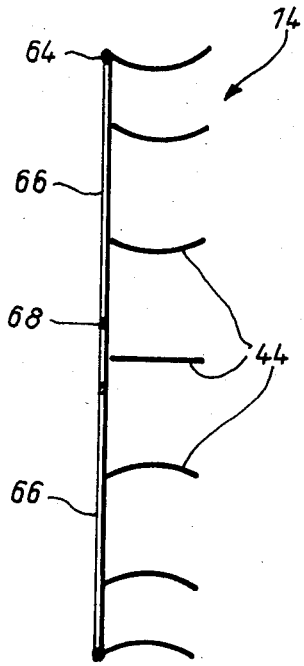
FIG. 9 is a section along the line 9—9 of FIG. 8.

In the embodiment example according to FIGS. 8 and 9 the rerouting unit 14 consists of a wire 64 bent into a circle, which, in turn, is connected through radially extending wires or spokes 66 to a hub 68; laterally extending wire ribs 44, which are concavely curved, are welded to, and project from the annularly shaped wire 64, thus providing a substantially line-shaped support.

In connection with the aforedescribed rerouting units 14, use of contact disks 12, which are formed with a soft contact surface, which expand radially due to the centrifugal force, and which therefore permit achievement of a particularly soft band grinding, is especially advantageous. In particular, for the first time operation of contact disks is possible, which does not require any adjustment of the tension of the band; namely the contact-forming surface of the contact disks is formed by laminae made, for example of textile material, which peripherally abut a rigid disk, and, while being normally slack, expand radially when the rigid disk is rapidly rotated due to the centrifugal force acting thereon; such laminae thus effectively increase the diameter of the disk under those circumstances, so as to form an extremely yieldable support for the grinding band. Consequently the grinding band, which is largely free of any tension, may now be still better matched, than has been the case hitherto, to any curvatures or channels formed in a surface of the workpiece.

While the invention has been illustrated in preferred embodiments, it is not to be limited to the structures shown, since many variations thereof will be evident to one skilled in the art, and are intended to be encompassed in the present invention as set forth in the following claims.

I claim:

1. In a grinding machine using a longitudinal grinding band, and including a frame, a driven contact disk having an axle, and supported in the frame on said axle, a rotatable rerouting unit having a shaft disposed approximately parallel with said axle, said grinding band being guided over said contact disk and over said rerouting unit, the improvement in said rerouting unit comprising a plurality of members peripherally spaced from one another and extending transverse to the longitudinal direction so as to form substantially line-shaped supports for said grinding band, each member having a concavely formed side facing said grinding band, whereby the grinding band operatively assumes a substantially polygonal shape as seen in a sideview thereof.

2. The grinding machine as set forth in claim 1, wherein each member is a cross-bar.

3. The grinding machine as set forth in claim 1, wherein each member is a cross-rib.

4. The grinding machine as set forth in claim 1, wherein each member is a cross-edge member.

5. The grinding machine as set forth in claim 1, wherein each member has a concavely curved side facing said grinding band.

6. The grinding machine as set forth in claim 1, wherein each member has radially outwardly projecting lateral rim portions guiding said grinding band therebetween.

7. The grinding machine as set forth in claim 1, wherein said members form a peripheral support surface for said grinding band, wherein said rerouting unit includes a hub, and wherein each member is a U-shaped wire member extending radially from said hub.

8. The grinding machine as set forth in claim 1, wherein said members form a peripheral support surface for said grinding band, wherein said rerouting unit includes a hub, and wherein each member is a plate-shaped member.

9. The grinding machine as set forth in claim 8, wherein each member is made of synthetic material.

10. The grinding machine as set forth in claim 8, wherein each member is punched from metal.

11. The grinding machine as set forth in claim 1, wherein said members form a peripheral support surface for said grinding band, and wherein at least a support-forming part of each member is made of resilient material.

12. The grinding machine as set forth in claim 1, wherein said members form a peripheral support surface for said grinding band, and wherein at least a support-forming part of each member is made of bendable material.

13. The grinding machine as set forth in claim 1, wherein said members form a peripheral support surface for said grinding band, and wherein at least a support-forming part of each member includes adhesive means.

14. The grinding machine as set forth in claim 13, wherein said adhesive means includes rubber.

15. The grinding machine as set forth in claim 1, wherein said members form a peripheral support surface for said grinding band, and further comprising a rubber ring under tension extending over said support surface.

16. The grinding machine as set forth in claim 1, wherein said members form a peripheral support surface for said grinding band, said peripheral support surface having a predetermined diameter, and wherein said rerouting unit has a very low moment of inertia in relation to said diameter.

17. The grinding machine as set forth in claim 1, wherein said grinding band includes upper and lower strands, and further comprising a slide surface disposed within a region of said upper strand in a plane about tangent both with said contact disk and with said rerouting unit, said upper strand band being guided along said slide surface, while said lower strand is freely suspended downwardly from said contact disk and from said rerouting unit.

18. The grinding machine as set forth in claim 1, wherein said grinding band includes upper and lower strands, and further comprising a slide surface disposed within a region of said upper strand in a plane about tangent both with said contact disk and with said rerouting unit, and band-tensioning means exerting an adjustable pressure on said grinding band, said upper strand band being guided along said slide surface, said lower strand being suspended downwardly while being acted on by said band-tensioning means.

19. The grinding machine as set forth in claim 18, further comprising a second rotatable rerouting unit abutting an inner side of said grinding band, said second rerouting unit including a set of members spaced from one another and extending in a direction transverse to the longitudinal direction of the grinding band, each of said set of members substantially abutting said grinding band in a line-like manner.

20. The grinding machine as set forth in claim 1, wherein said grinding band includes a lower strand, and further including under-pressure generating means, said lower strand being passed through said under-pressure generating means so that the under-pressure thereof pulls said grinding band slightly downwardly.

21. In a grinding machine using a longitudinal grinding band, and including a frame, a driven contact disk having an axle, and supported in the frame on said axle, a rotatable rerouting unit having a shaft disposed approximately parallel with said axle, said grinding band being guided over said contact disk and over said rerouting unit, the improvement in said rerouting unit comprising a plurality of members peripherally spaced from one another and extending transverse to the longitudinal direction so as to form substantially line-shaped supports for said grinding band, each member having radially outwardly projecting lateral rim portions guiding said grinding band therebetween, whereby the grinding band operatively assumes a substantially polygonal shape as seen in a sideview thereof.

22. The grinding machine as set forth in claim 1, wherein said grinding band is made of material which does not resist bending, and wherein said rerouting unit is operatively entrained by said grinding band at low tension.

* * * * *